US007770342B2

(12) United States Patent
Marschke

(10) Patent No.: US 7,770,342 B2
(45) Date of Patent: Aug. 10, 2010

(54) HOLLOW CORE FLOOR AND DECK ELEMENT

(76) Inventor: Carl R. Marschke, N9955 Memory La., Phillips, WI (US) 54555

( * ) Notice: Subject to any disclaimer, the term of this patent is extended or adjusted under 35 U.S.C. 154(b) by 516 days.

(21) Appl. No.: 11/777,002

(22) Filed: Jul. 12, 2007

(65) Prior Publication Data

US 2008/0010943 A1 Jan. 17, 2008

Related U.S. Application Data

(63) Continuation-in-part of application No. 11/485,823, filed on Jul. 13, 2006, now abandoned.

(51) Int. Cl.
*E04C 5/08* (2006.01)

(52) U.S. Cl. ..... 52/223.1; 52/223.6; 52/223.14

(58) Field of Classification Search ..... 52/223.6, 52/223.14, 223.1, 223.7, 240, 291, 657; 135/135, 135/159, 907

See application file for complete search history.

(56) References Cited

U.S. PATENT DOCUMENTS

| | | | | | |
|---|---|---|---|---|---|
| 1,428,484 | A | * | 9/1922 | Lankheet | 52/223.1 |
| 1,721,198 | A | * | 7/1929 | Athey | 135/149 |
| 2,183,451 | A | * | 12/1939 | Forster | 52/222 |
| 2,577,582 | A | * | 12/1951 | Hammitt et al. | 52/478 |
| 2,779,980 | A | * | 2/1957 | Rhodes | 52/291 |
| 3,153,303 | A | * | 10/1964 | Wheeler | 52/73 |
| 3,292,313 | A | * | 12/1966 | Entwistle | 52/74 |
| 3,427,811 | A | * | 2/1969 | White | 405/259.3 |
| 3,434,901 | A | | 3/1969 | Griffiths et al. | |
| 3,488,968 | A | * | 1/1970 | Barkeling | 405/218 |

(Continued)

FOREIGN PATENT DOCUMENTS

| | | |
|---|---|---|
| FR | 1212042 | 3/1960 |

(Continued)

OTHER PUBLICATIONS

International Search Report dated Jan. 15, 2008.

(Continued)

*Primary Examiner*—Robert J Canfield
*Assistant Examiner*—Brent W Herring
(74) *Attorney, Agent, or Firm*—Andrus, Sceales, Starke & Sawall, LLP

(57) ABSTRACT

A stress-optimized structural support which may be utilized as a beam or assembled with similar supports to form a building floor or roof panel or a bridge deck utilizes an open core element, made preferably of suitably treated fluted paper, upper and lower thin skin sheets, preferably steel skins, and a layer of concrete poured over the top skin. Modules comprising the hollow core element and the upper and lower skin sheets are fabricated to lengths required for building floor, roof or bridge spans and, when joined by welding or otherwise joining the upper and lower skin sheets of adjacent elements along their full lengths, provide a floor or roof deck structure of a large span with horizontal stresses distributed omnidirectionally. A post-stressing tensile system redistributes and reduces the load on the roof deck by about one-half. Small building decks utilizing the stress redistribution system can be combined to build a large span roof in which multiple tensioning systems are coordinated to simultaneously effect the load redistribution.

13 Claims, 11 Drawing Sheets

U.S. PATENT DOCUMENTS

| | | | | | |
|---|---|---|---|---|---|
| 3,611,548 | A | * | 10/1971 | Parris | 29/428 |
| 3,707,817 | A | | 1/1973 | Schmitt et al. | |
| 3,879,805 | A | * | 4/1975 | Gretter | 24/71.1 |
| 3,943,994 | A | | 3/1976 | Cleveland | |
| 4,012,276 | A | | 3/1977 | Schertler | |
| 4,126,508 | A | | 11/1978 | Hoelzinger | |
| 4,433,788 | A | * | 2/1984 | Erlam et al. | 211/26 |
| 4,500,381 | A | | 2/1985 | Nordstrom | |
| 4,878,700 | A | * | 11/1989 | Brune | 292/241 |
| 4,948,445 | A | | 8/1990 | Hees | |
| 5,205,096 | A | * | 4/1993 | Pace | 52/223.6 |
| 5,674,593 | A | | 10/1997 | Earl | |
| 5,992,112 | A | | 11/1999 | Josey | |
| 6,138,702 | A | * | 10/2000 | Carter | 135/145 |
| 6,253,530 | B1 | | 7/2001 | Price et al. | |
| 6,405,509 | B1 | | 6/2002 | Razl | |
| 6,467,223 | B1 | | 10/2002 | Christley | |
| 6,539,679 | B1 | * | 4/2003 | Brasington | 52/223.6 |
| 6,581,617 | B2 | * | 6/2003 | Ham et al. | 135/135 |
| 6,711,872 | B2 | | 3/2004 | Anderson | |
| 6,800,351 | B1 | | 10/2004 | Pflug et al. | |
| 6,890,398 | B2 | | 5/2005 | Sing | |
| 6,913,667 | B2 | | 7/2005 | Nudo et al. | |
| 2002/0062611 | A1 | | 5/2002 | Pryor | |
| 2007/0131265 | A1 | * | 6/2007 | Choi | 135/135 |

FOREIGN PATENT DOCUMENTS

| | | | |
|---|---|---|---|
| FR | 1373515 | | 9/1964 |
| GB | 783362 | | 9/1957 |
| GB | 1 444 346 | | 7/1976 |
| JP | 06042180 | A * | 2/1994 |

OTHER PUBLICATIONS

Ruzzene, Massimo et al, Control of Wave Propagation in Sandwich Plate Rows with Periodic Honeycomb Core; Journal of Engineering Mechanics; Sep. 2003; pp. 1-12.

Seidl, Robert J. et al, Paper-Honeycomb Cores for Structural Sandwich Panels 1, 2; Report No. 1918, Jul. 1965; pp. 1-34.

Seidl, R.J. et al, national Advisory Committee for Aeronautics; Technical Note 2564; Nov. 1951.

Wadley, Haydn N.G. et al; Fabrication and structural performance of periodic cellular metal sandwich structures; Composites Science and Technology, vol. 63, 2003, pp. 2331-2343.

Zupan, M. et al, The out-of-plane compressive behaviour of woven-core sandwich plates; European Journal of Mechanics A/Solids, vol. 23, 2004, pp. 411-421.

* cited by examiner

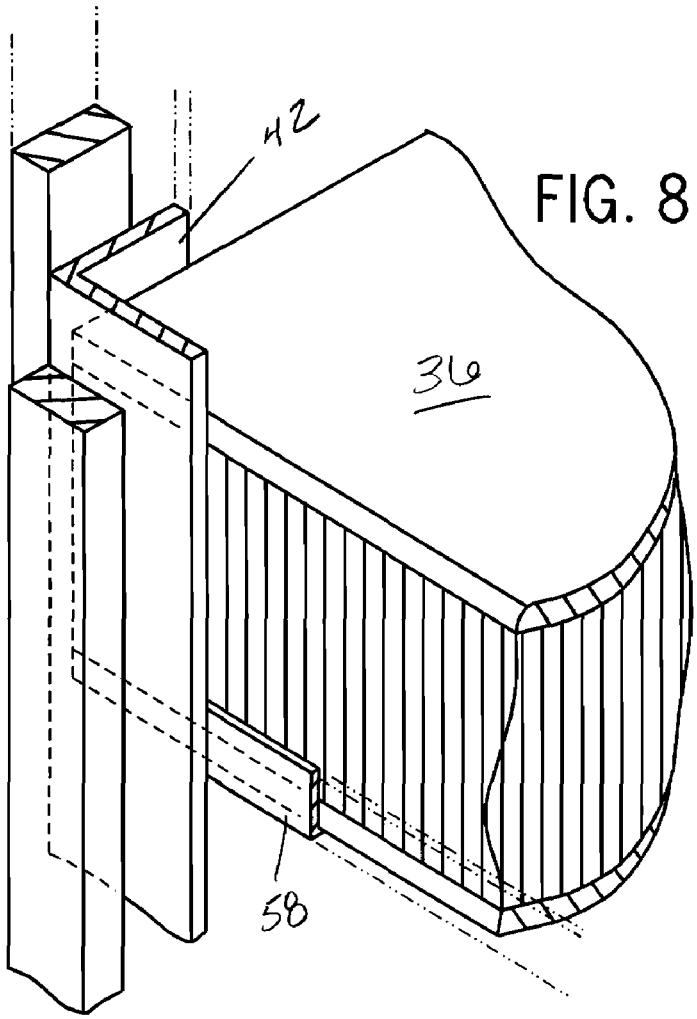
FIG. 8
FIG. 9
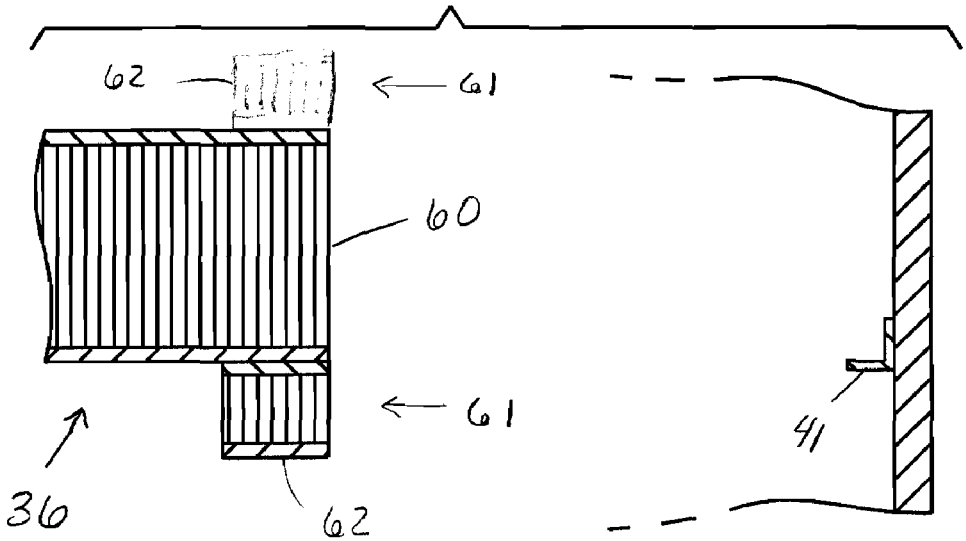

HOLLOW CORE FLOOR AND DECK ELEMENT

RELATED APPLICATION

This is a continuation-in-part of application Ser. No. 11/485,823, filed on Jul. 13, 2006 now abandoned.

BACKGROUND OF THE INVENTION

The present invention pertains to a lightweight hollow core structural building element which can be used as a beam or can be joined with other elements to form a floor, deck or wall panel.

The potential for the use of hollow core elements in the construction of buildings and other structures has been known for many years. Hollow cores of corrugated or honeycomb paper or metal sheet material, enclosed by upper and lower skin panels or sheets, have long been used or proposed for use as floor, wall and roof panels for buildings. However, the use of such hollow core panels has been inhibited because of difficulties in fabricating the panels in an efficient and cost effective manner.

It is known in the prior art to construct building floors or decks with structures that are reinforced and oriented such that loads are distributed in orthogonal directions (e.g. in the direction of main supporting beams and perpendicular thereto). In one such type of construction, as applied to a flat roof structure, parallel main support beams are tied together with bar joist trusses which help distribute the load in directions perpendicular to the beams.

In another type of construction, a concrete floor slab has steel reinforcing running in two directions that are perpendicular to one another, again in an attempt to more evenly distribute the load in both directions. Concrete is eliminated in recessed portions bounded by the steel reinforcing in a sort of inverted egg carton construction.

In both of the foregoing modes of construction, larger spans are attainable by virtue of the orthogonal load distribution. However, both of the foregoing floor plate constructions utilize large amounts of expensive steel and/or relatively massive amounts of concrete.

In my co-pending patent application Ser. Nos. 11/476,474, entitled "Method and Apparatus for Manufacturing Open Core Elements from Web Material", filed Jun. 28, 2006, and 11/769,879, entitled "Method and Apparatus for Manufacturing Open Core Elements from Web Material", filed Jun. 28, 2007, which application are incorporated by reference herein, there is disclosed a system for manufacturing hollow core panels of widely varying dimensions using corrugating techniques and a unique lay-up process.

SUMMARY OF THE INVENTION

In accordance with one embodiment of the present invention, a structural support, such as a floor or bridge deck, is fabricated from open core elements faced with upper and lower steel skins which are welded or otherwise joined together. A layer of concrete may be poured over the upper surface. When applied to a roof panel, the concrete is preferably eliminated. The invention encompasses the modules, the overall structural support, and the method of making the same, and a large span roof made of a plurality of modules.

In one aspect of the invention, a horizontal structural support includes an open core element that has a plurality of corrugated strips of a web material bonded together and having the flutes oriented vertically. The open core element defines horizontal upper and lower surfaces to which steel skins are attached. A layer of concrete may be placed on the upper steel skin. If a concrete layer is used, the structural support may include a plurality of upstanding steel projections that are attached to the upper steel skin and are embedded in the concrete layer.

In another embodiment, a plurality of open core elements are provided, each having upper and lower steel skins that are co-extensive with and attached to the core element and shaped to define modules of a generally rectangular shape. The modules are connected edge-to-edge with welded joints or other connectors along abutting edges of the upper and lower skins to form a deck. The deck forms a unitary plate that provides omni-directional stress distribution which, when used as a roof, can be post-stressed to enhance the load carrying capability. When used as a floor deck, a layer of concrete may be placed over the entire deck. Close-out panels may be placed to enclose portions of the assembled core elements that define the outer periphery of the deck. Alternately, the close out panels, which are securely attached to the top and bottom skins, are then glued together at the construction site to bond the modules into a continuous plate structure. In a presently preferred construction, the web material for making the open core elements is paper and, most preferably, resin-impregnated paper to make it waterproof.

When utilized as a building roof or as a module for a large span roof, the present invention includes a unique post-stressing system and method in which as much as half of the load on the continuous roof plate structure is diverted. A pair of diagonally extending, generally orthogonal tension strips are stressed with a hydraulic force mechanism that pushes the strips away from the underside of the roof plate structure with a counterforce directed upwardly into the roof plate to overcome the dead weight deflection of the panel and, desirably, provide a positive upward deflection to carry the additional load of roofing materials and snow and ice loads.

The invention also includes a method for making a load bearing deck or the like comprising the steps of: forming an open core element from a plurality of long and relatively narrow strips of a corrugated web material by bonding the strips together with the flutes extending between and perpendicular to the long edges of the strips, and with the open core element defining parallel rectangular upper and lower surfaces perpendicular to the flutes; bonding rectangular steel skins to the upper and lower surfaces of the core element to form a deck module, the skins each having opposite long edges that correspond to the length of the strips; and, connecting adjacent modules by welding or otherwise securing together the long edges of adjacent upper skins and lower skins. The structure acts as a continuous membrane or plate. The method may further include the step of pouring a layer of concrete over the interconnected upper skins to form the deck. The method preferably includes, prior to the concrete pouring step, the step of attaching a plurality of upstanding steel projections to the exposed surfaces of the upper skins, and the pouring step includes embedding the projections in the concrete. Also prior to the pouring step, the method may include the step of placing utility connections or chases for such connections on the exposed surface of the upper skins and embedding the connections or chases in the concrete during the pouring step.

In another aspect of the subject invention, a substitute for the steel skins is a metal, such as aluminum, or fiber-reinforced plastics and similar composites. Skin sheets using materials other than steel would similarly be bonded to the upper and lower surfaces of the core element and adjacent deck modules would be joined together along the long edges of adjacent upper and lower skin sheets, using joining techniques appropriate for the skin sheet material being used.

In accordance with one method of the present invention, the strips of corrugated web material used for forming the open core elements comprise strips of adhesively-joined fluted web and smooth web. The webs are preferably made of paper and the method comprises the additional step of water proofing the paper webs. The water proofing step may comprise applying an A-phase phenolic resin to the paper web and drying it to the B-phase before the forming step, and heating the open core elements after forming to a temperature sufficient to thermoset the resin.

A structural roof plate or floor plate, made in accordance with the present invention, includes a rectangular open core element that is formed from strips of a web material that are expanded and connected to define open cores and having the open cores oriented to extend vertically. The open core elements have parallel upper and lower surfaces to which skin sheets are attached. A peripheral compression member encloses the core element and a pair of post-stressing tensile members are attached to the core element and the compression member to extend diagonally across the underside of the core element between opposite corners. A tensioning device interconnects the tensile members at their intersection and the underside of the core element. The tensioning device operates to move the tensile members vertically away from the underside of the core element and to impose a desire tensile load in the tensile members and a balancing compression load in the peripheral compression member.

The web material for the floor plate core element preferably comprises corrugated paper. The web may be made waterproof and open core filled with an insulating foam. The floor or roof plate includes an anchor plate at each corner of the core element to provide an interconnection between the core element, the compression member and the tensile members. The anchor plate also serves as a bearing plate for supporting the roof or floor plate on vertical corner columns.

The tensioning device for post-stressing the tensile members includes a fluid cylinder that has a cylinder body embedded in the open core element and a rod end connected to the tensile members at their intersection. An operating system applies fluid pressure to the cylinder to extend the rod end. In a presently preferred embodiment, the operating fluid comprises the liquid components of a hardenable epoxy adhesive. The operating system functions to hold the cylinder rod end in a selected extended position until the epoxy adhesive hardens. A load distribution plate is fixed to the cylinder body and bears against the lower skin sheet of the core element to help distribute the load. A connector plate is attached to the rod end of the cylinder and bears against the connected tensile members.

The peripheral compression member preferably comprises reinforced concrete. There is a peripheral support for the compression member that preferably comprises a rectangular array of angle members, each angle member having a horizontal flange that supports the compression member, the horizontal flange in turn being supported at opposite ends on the anchor plates.

The roof plate just described can be used in a multiple array for a large span roof for a building. The large span roof includes a plurality of rectangular open core roof modules positioned side-to-side and end-to-end to define the roof. Each module is formed from strips of a web material expanded and connected to define open cores. The open cores are oriented to extend vertically and define horizontal upper and lower surfaces. Skin sheets are attached to the upper and lower surfaces of the roof modules. A major peripheral compression member encloses the large span roof and minor peripheral compression members enclose each module. A pair of post-stressing tensile members are attached to each roof module and extend diagonally across the underside of the module between opposite corners. A tensioning device interconnects the tensile members at their intersection with the underside of the module. The tensioning device operates to move the tensile members at their intersection vertically away from the underside of the core element to impose a desired tensile load in the tensile members and to impose a balancing compression load in the major and minor compression members.

The junctions of the ends of the tensile members of adjacent modules, and the junctions of the ends of the tensile members with the ends of minor peripheral compression members and with the major peripheral compression member are connected. The corners of the modules are supported on vertical columns. The major peripheral compression member is made of reinforced concrete and rests on a horizontal flange of a peripheral angle member, the angle member being attached to and supported by the columns. The peripheral edge of the roof rests on the horizontal flange and is tied to the concrete compression member. The minor peripheral compression members are preferably made of steel, but hollow-core beams made in the manner of the basic hollowcore module may also be used.

In order to provide means for attaching equipment, equipment hangers and the like to the underside of an open core module, connector supports, preferably made of wood, are embedded in the open core element and have surface portions that are in contact with a skin sheet, such as the lower skin of the module. The supports are parallel and uniformly spaced across the width of the element and extend the full length thereof.

BRIEF DESCRIPTION OF THE DRAWINGS

FIG. 8 is an enlarged detail taken on line 8-8 of FIG. 7.

FIG. 9 is an enlarged detail taken on line 9-9 of FIG. 7.

DETAILED DESCRIPTION OF THE PREFERRED EMBODIMENTS

Figure 1:
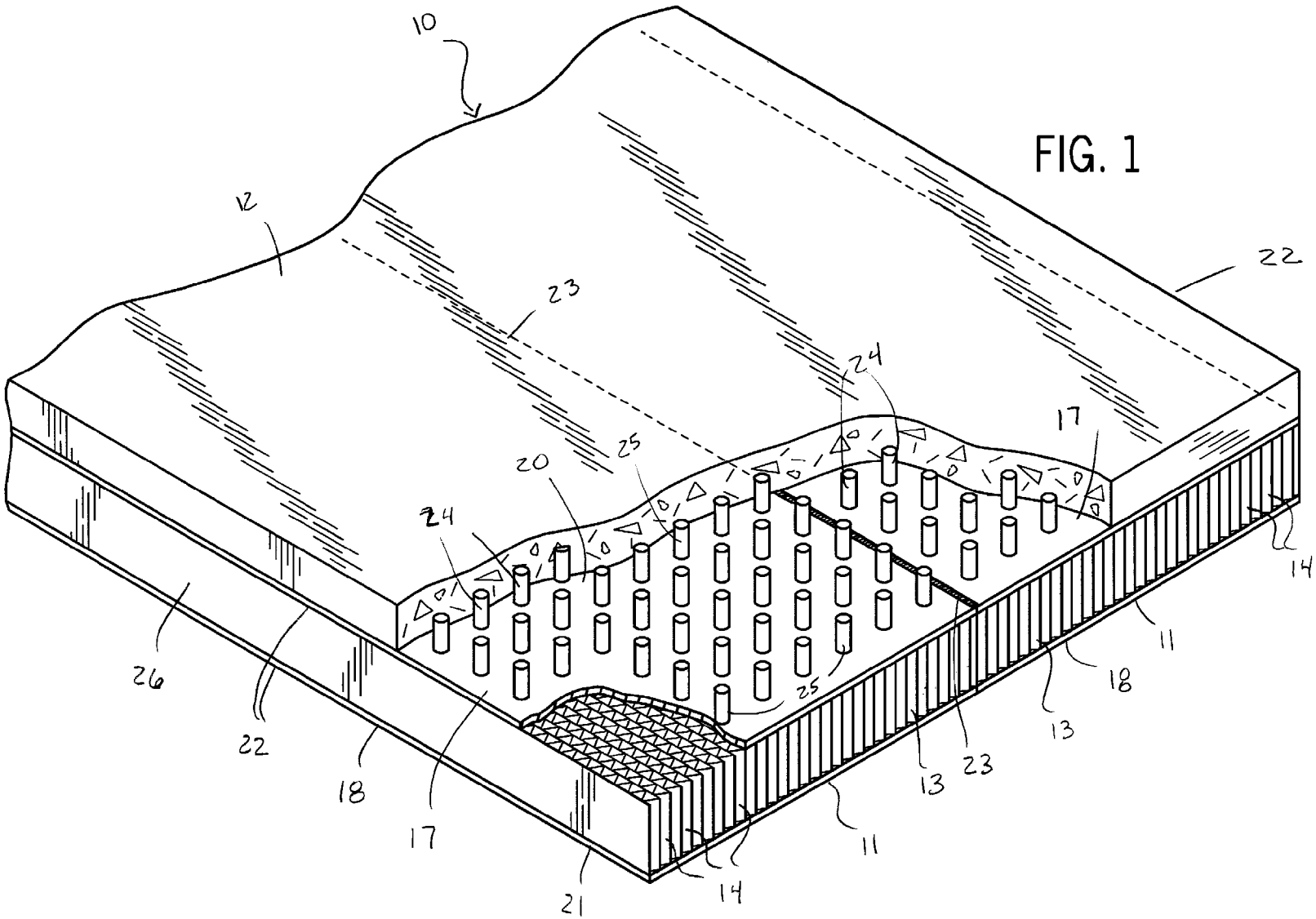
FIG. 1 is a perspective view of a structural deck or floor assembled from modules according to the present invention.

Referring first to FIG. 1, there is shown a portion of a deck 10 or floor useful, for example, in the construction of a bridge or a building, in which a series of long and relatively narrow modules 11 are joined together and, optionally, covered with a poured concrete slab 12. Each of the modules 11 (shown in FIG. 2) could be made of any desired dimensions, but for use in a floor deck, for example, module 11 could have a depth or thickness of 24 in., a width of 10 ft. and a length of 50 ft. To fabricate a deck 10 50 ft. long and 50 ft. wide, five modules 11 would be joined along their long edges, as partly shown in FIG. 1.

Each deck module 11 includes a hollow core element 13 of the type described and manufactured in accordance with the method disclosed in my above identified patent application. The hollow core element 13 includes a stack of long, narrow corrugated paperboard strips 14, each of which in the embodiment shown comprises a fluted web 15 and a smooth web 16 joined with a suitable adhesive. The webs 15 and 16 may be made of many suitable materials, but resin-impregnated paper is presently preferred.

In accordance with the hollow core lay-up method of my above-identified application, flutes are formed in the fluted web 15 of a substantially larger size than typically used for corrugated paperboard. The flutes may have a height of about ½ in. and, in order to provide a stack of strips 14 to make a module 11 with a 10 ft. width, approximately 240 strips would be required. The strips are 24 in. wide and 50 ft. long. The method and apparatus of my above-identified application are capable of forming up hollow core elements of the required size.

Figure 2:
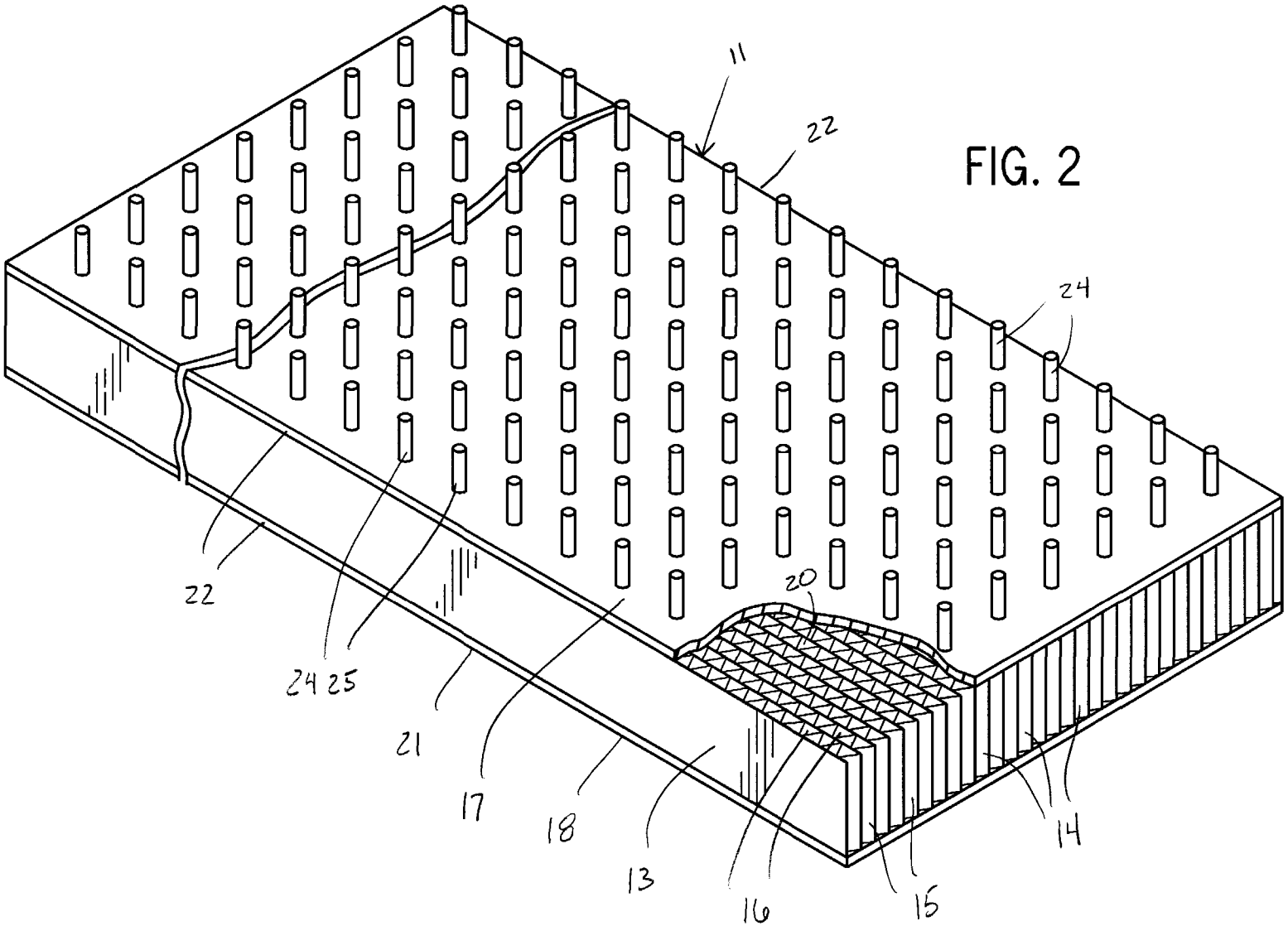
FIG. 2 is a perspective view, similar to FIG. 1, showing a single open core module used in fabricating the deck of FIG. 1.

Each of the rectangular hollow core elements 13 has plan dimensions of 10 ft. by 50 ft. Steel sheets comprising an upper skin 17 and a lower skin 18 are attached to the respective upper and lower surfaces 20 and 21 of the hollow core element 13. The upper skin 17 may be, for example, 0.062 in. or less in thickness (for example as thin as 0.020 in.) and the lower skin 18 may be 0.125 in. in thickness and possibly as thin as 0.020 in. In such arrangements, the depth of core could be reduced down to 18 in. Although high modulus steel is preferred, other materials may be utilized, particularly for the upper skin where tensile strength and high modulus of elasticity are not major concerns. The skins 17 and 18 may be secured to the hollow core element 13 with any of a number of suitable adhesives, including epoxies. The resulting deck module 11 of FIG. 2 is attached to like modules to fabricate the deck 10 shown in FIG. 1. Modules 11 are positioned side-by-side, preferably in their final positions in the structure in which they are used, with the long edges 22 of the steel skins 17 and 18 abutting. In this position, each abutting pair of upper skins 17 and lower skins 18 are connected with welds 23.

The upper surface of the upper skins 17 may be provided with an array of upstanding projections 24, preferably short steel posts 25 which are welded to the skin 17. The height of the posts 25 depends on the thickness of the concrete slab 12, but for a 2 in. slab, posts having a height of about 1.5 in. are satisfactory. Once the modules 11 are welded together, concrete is poured onto the upper skin surfaces to form a slab 12 of a desired thickness. Any necessary utility connections, such as electric power conduits, piping and the like are placed on the upper skin surface and embedded in the subsequently poured concrete.

The exposed core elements 13, along the outer periphery of the fabricated deck 10, are closed with suitable close-out panels 26. The panels 26 may be made of any suitable material and glued, welded or otherwise secured to the exposed core elements 13 or the edges of the skins 17 and 18.

Although the composite structural support of the present invention has been described with respect to the fabrication of a floor for a building or a deck for a bridge, the present invention lends itself well to the fabrication of structural supports of a wide variety of shapes and sizes. For example, a much narrower module, namely one using a much smaller number of strips 14 (say 16 strips stacked to form a hollow core element about 8 in. wide) can function as a beam.

A floor, deck or beam member made in accordance with the present invention could be provided with a camber as is sometimes done in long span beams. The inherent flexibility of the fluted paper core element 13 will permit the necessary flexure to be imparted to provide a camber. For example, one of the skins 17 or 18 is applied to the core element, the element then flexed to the desired camber and the other skin attached to the core in the bowed orientation.

The stresses in the lower skin 18 of a deck 10 made in accordance with the present invention are very low and are uniformly distributed omni directionally throughout the lower skin. As a result, materials other than steel may be used for the lower skin, including aluminum, fiberglass and other fiber-reinforced plastic composites.

The narrow strips 14 of corrugated web material preferably comprise paper and, as indicated above, include a fluted web 15 and a smooth web 16. As also indicated previously, resin-impregnated paper is preferred. The resin impregnation provides a water proofing that protects the paper cores in the presence of moisture. One effective way of providing the water proofing is to apply an A-phase phenolic resin to the paper web and drying it to the B-phase before forming the open core elements 13. Then, after formation, core elements are heated to a curing temperature sufficient to cause thermal setting of the phenolic resin.

It may be desirable to construct a deck module 11 of the present invention to prevent the ingress and accumulation of water in the flute spaces defined by the hollowcore element 13. One particularly suitable filler would be ultra-expanded closed cell foam. One method of filling the flute spaces is to first apply one of the skin sheets 17 or 18 to the hollowcore 13 and then fill the flute spaces with the liquid components necessary to generate the foam. After the foaming chemicals are in place, the opposite panel face is closed and the entire element is inverted so that the foam that is generated reaches the entire open flute space. It may be desirable to provide relief through one of the skins to permit expanding gases to exhaust.

Figure 3:
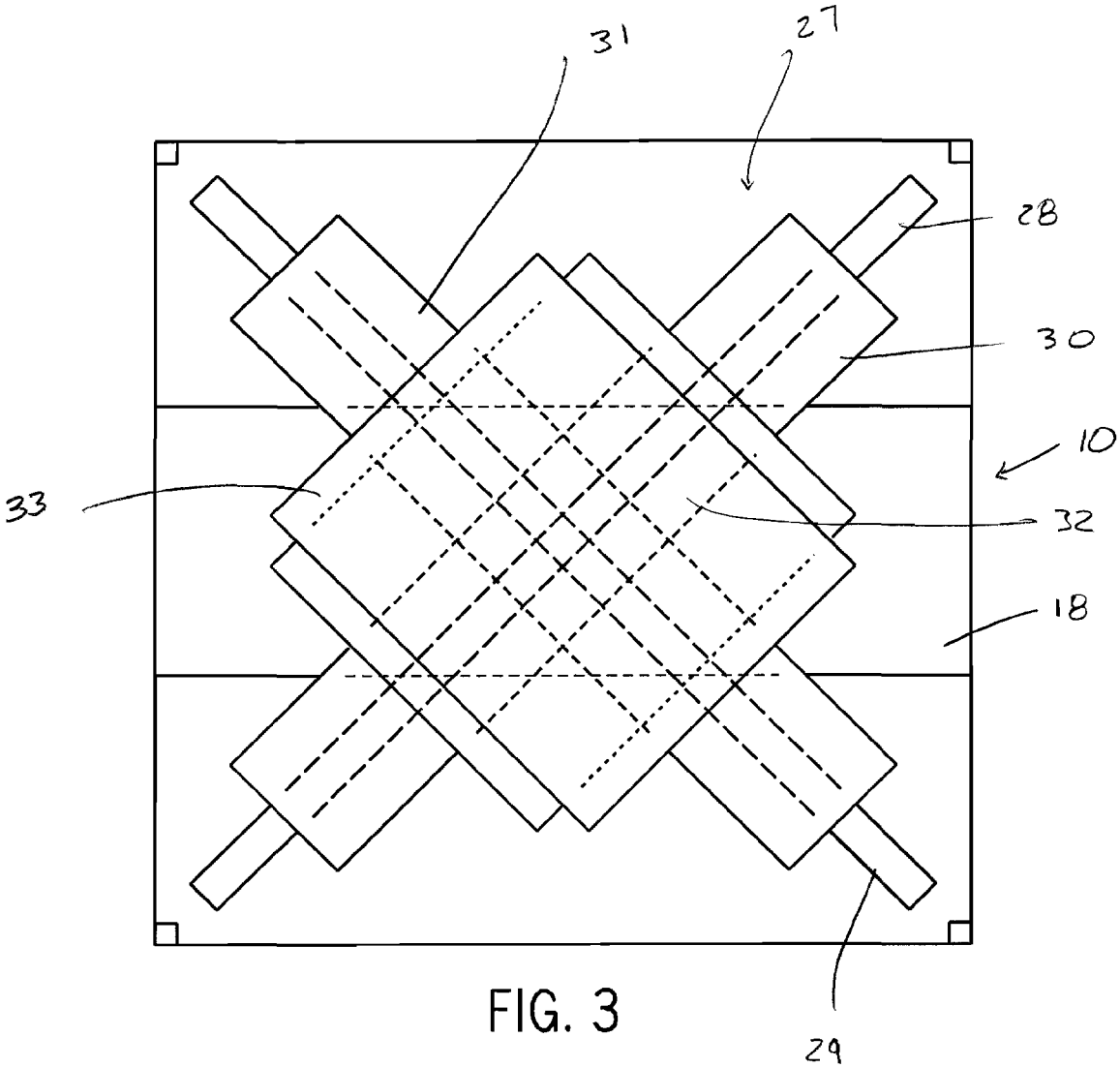
FIG. 3 is a bottom plan view of the FIG. 1 deck, showing reinforcing strips used in long-span construction.

In the example discussed above, 50 ft. modules 11 having a length of 50 ft. and a width of 10 ft. are joined to fabricate a 50 ft.×50 ft. deck. In certain applications, in order to retain the long span and eliminate additional supporting columns and beams, supplemental reinforcing skin strips may be added as shown in FIG. 3. A series of long and narrow reinforcing strips 27 are attached to the lower skin 18 in a built-up diagonal orientation. In the arrangement shown, the first and second strips 28 and 29 are the narrowest and extend generally perpendicular to one another and nearly the entire diagonal distance across the lower skin 18. These and the subsequently applied strips are preferably made of fiberglass with the glass fiber orientation being primarily in the long direction, for example, 90% of the fibers. The strips are applied with a resin adhesive and, in a preferred embodiment, the strips are laid in tension and held until the resin cures to provide a slight camber to the deck module 11. The camber is subsequently eliminated when the concrete layer 12 is laid on the upper surface. The second strip 29, identical in size and shape to the first strip 28, is laid diagonally and perpendicular to the first strip.

Third and fourth strips 30 and 31, which are wider and shorter than the first and second strips 28 and 29, are added. Fifth and sixth strips 32 and 33, again shorter and wider than the third and fourth strips 30 and 31, complete the reinforcing strip arrangement shown in FIG. 3. Obviously, more or less strips of different dimensions could be used, as required. This arrangement can also be utilized to permit the use of a thinner lower skin 18, possibly as thin as 11 gauge (about ⅛ inch or 3 mm), possibly as thin as 0.015 in. This built-up strip arrangement concentrates the reinforcing at the center of the deck where the stresses are greatest.

Any suitable skin material may be used for the reinforcing strips and the material may be the same as or different than the material used for the lower skin 18. The upper skin layer 17 is not as critical from a strength standpoint and, as indicated above, the upper skin 17 may be much thinner (e.g. half the thickness) than the lower skin 18. Thus, any suitable material may be used and, preferably, to which concrete will bond.

In the process of attaching the upper and lower skins 17 and 18 to the hollow core element 13, it is important to assure that an adequate amount of adhesive reaches the interface between the edges of the open core webs 15 and 16 and the respective skin sheet 17 or 18.

Figure 4:
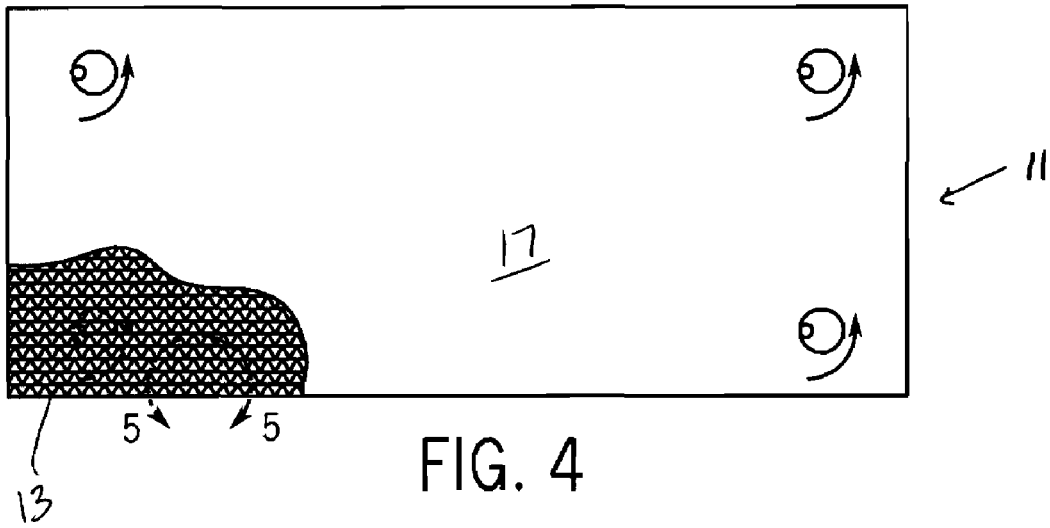
FIG. 4 is a bottom plan view of the deck module of FIG. 2 with a portion of the lower skin sheet broken away to show the interior construction.
Figure 5:
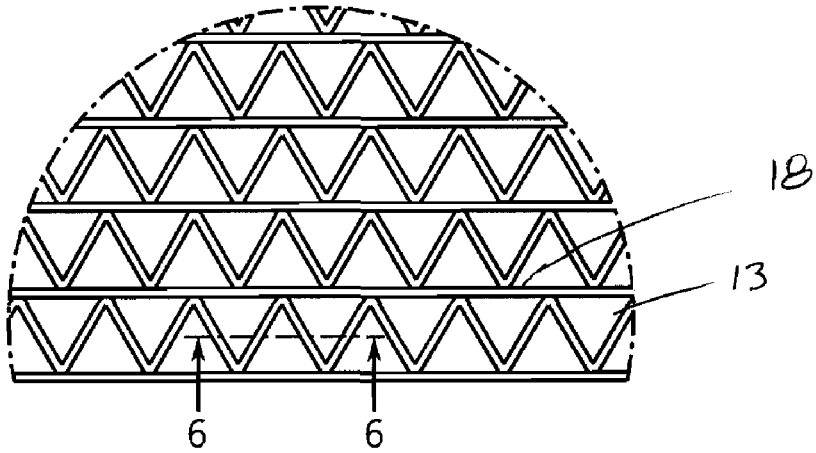
FIG. 5 is an enlarged detail of a portion of FIG. 4.
Figure 6:
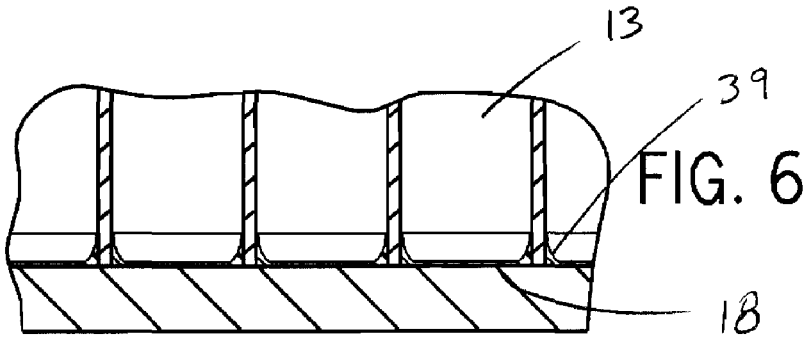
FIG. 6 is a section taken on line 6-6 of FIG. 5.

One method for maximizing the amount of adhesive at the interface is shown in FIGS. 4-6. A liquid adhesive layer 34 is applied to the inside surface of the skin sheet 18. The hollow core element is placed on the glued face of the skin sheet. The skin and core element are held together and supported on a rotating structure that rotates the entire structure in a gyratory motion on a small radius (e.g. ¼ inch or 6 mm) at approximately 300 rpm or more. This causes an accelerative force to be imposed on the adhesive that causes the adhesive to be pulled from the center of each flute space to the edges of the flute/skin interface where the adhesive will slightly climb the core element edges and assure an adequate adhesive fillet. The semi-completed deck module 11 is inverted and the process is applied to glue the other skin sheet to the hollow core element. Most conveniently, the process of filling the flute spaces with a closed cell foam may be carried out simultaneously by adding the liquid components of the foam after the first skin sheet is applied and then inverting the module.

Figure 7:
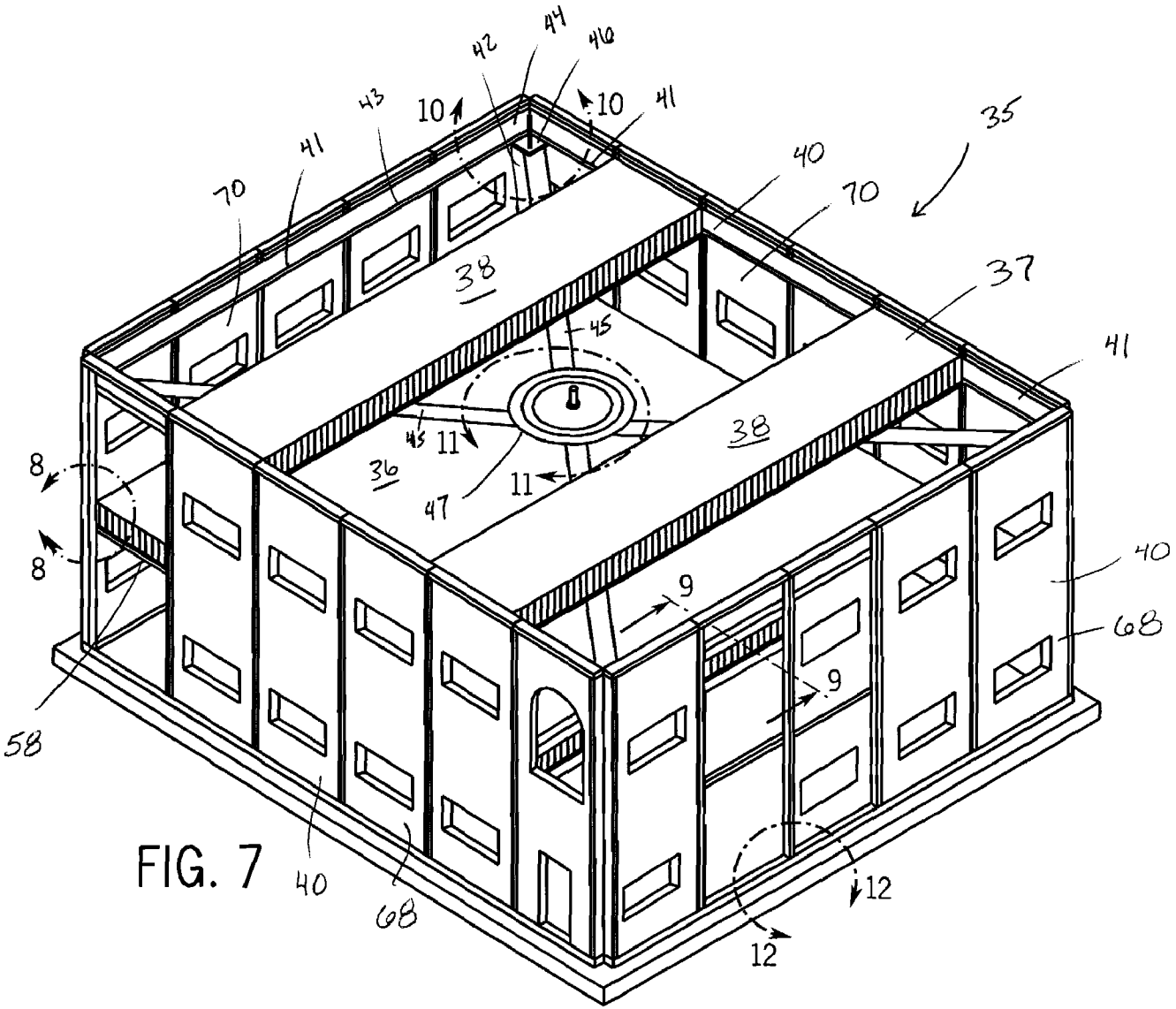
FIG. 7 is a perspective view of a two-story building with the roof and second floor are constructed of modules similar to those used to form the deck of FIG. 1.

Referring to FIG. 7, there is shown a two story building 35 in which the second floor 36 and the roof 37 are constructed using modules similar to those shown in FIG. 2 to form the deck 10. In the FIG. 7 example, the roof 37 has six modules, each 10 ft.×50 ft., resulting in a building having plan dimensions of 50 ft.×60 ft. The second floor 36 has only five modules, leaving a high ceiling foyer space at the front of the building, as will be discussed in more detail below.

The roof deck 38 is constructed in the manner described above, however, only two deck modules 11 are shown so other elements of the construction are more clearly visible. In the embodiment shown, the roof deck 38 is supported along the joined upper edges of building wall panels 40. An angle member 41 is attached to and extends along the upper inner face of the wall panels 40 which define the rectangular shape and size of the roof deck 38. At the corners of the wall panels, the ends of the angle members 41 are supported on a vertical column 42 which may be separate from the wall panels 40, as shown, or be formed integrally with the vertical edges of the wall panels. The horizontal flanges 43 of the rectangular array of angle members 41 also support a peripheral compression member 44 that surrounds and encloses the roof deck 38. The compression member 44 preferably comprises reinforced concrete having, for example, a cross section that is 3 in. wide and 24 in. deep, the depth being approximately equal to the depth of the hollow core modules 11.

A pair of post-stressing tensile members 45 extend diagonally across the underside of the roof deck 38 and are attached at opposite ends to the deck and the compression member 44. To facilitate interconnection of the members, an anchor plate 46, preferably made of steel, is attached near the upper end of each column 42 and to underside of the horizontal flanges 43 of the angle members 41. The tensile members 45, which may comprise steel strips ⅝ in. thick and 18 in. wide, may be welded or bolted to the anchor plates 46 and are also rigidly connected at their center crossing points. A tensioning device 47 provides a vertical connection between the tensile members 45 where they intersect and the underside of the deck 38. The tensioning device 47 operates to move the tensile members 45 vertically away from the underside of the deck and to impose a desired tensile load in the tensile members.

Figure 11:
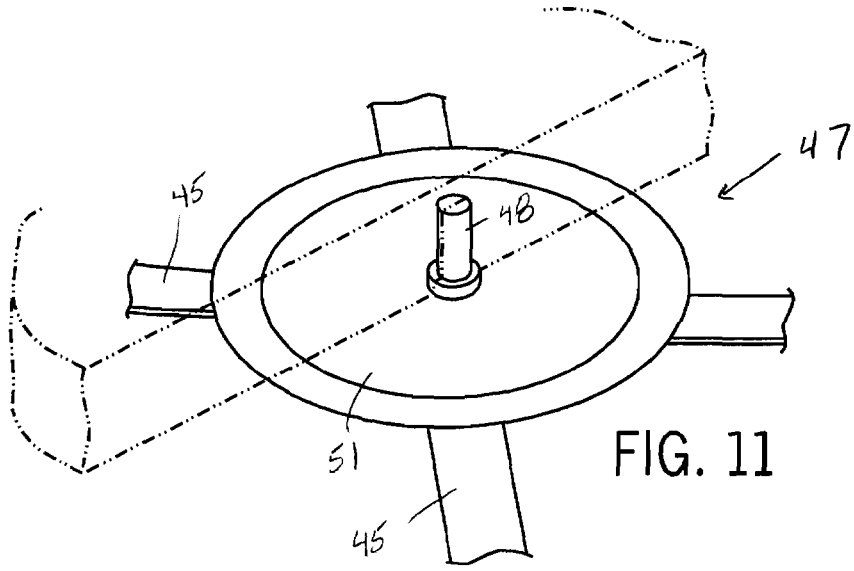
FIG. 11 is an enlarged detail taken on line 11-11 of FIG. 7.
Figure 13:
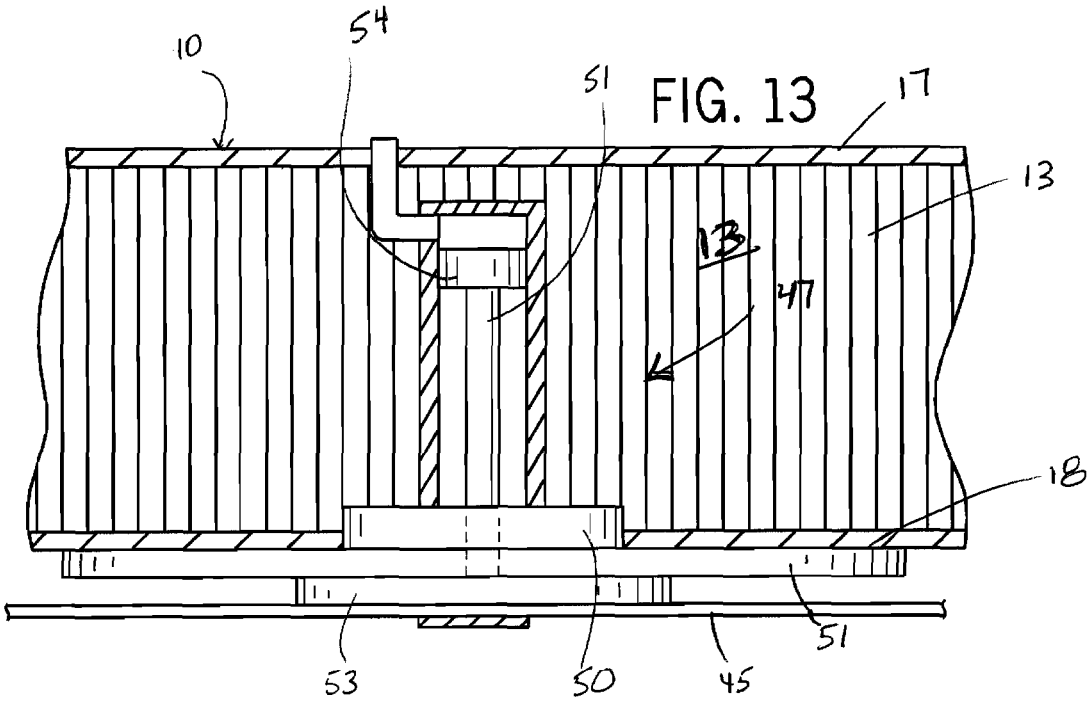
FIGS. 13 and 14 are enlarged vertical sections showing the construction and operation of the post-stressing system according to the present invention.
Figure 14:
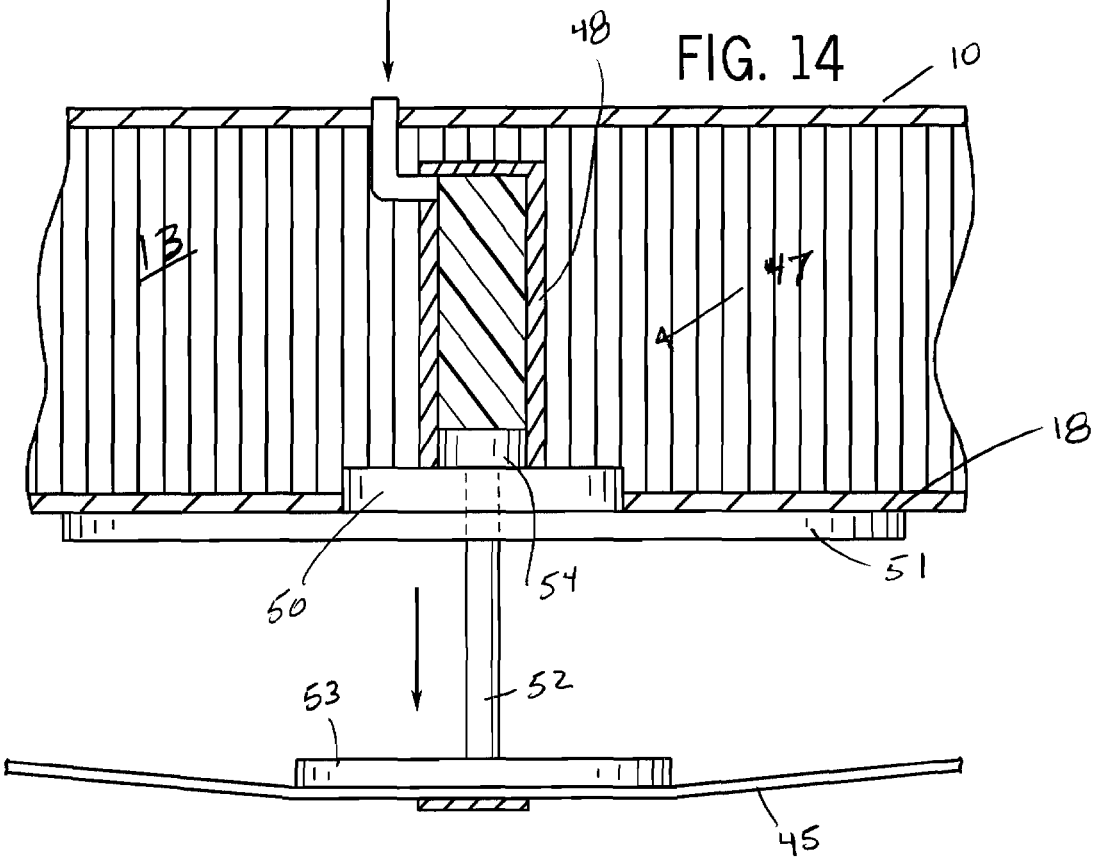

Referring also to FIGS. 11, 13 and 14, the tensioning device 47 includes a fluid cylinder 48 which is embedded in the hollow core 13 of the deck 38. The lower skin 18 of the deck is sandwiched between a cylinder end plate 50 and a load distribution plate 51 that bears against the underside of the skin. The load distribution plate 51 may, for example, be about 10 ft. in diameter. The rod end 52 of the cylinder is attached to the tensile members 45 at their intersection with a connector plate 53 somewhat smaller n diameter than the load distribution plate 51, for example, 18 in. By applying fluid pressure to the piston 54 of the cylinder 48, the rod end 52 is extended and the tensile members are pushed away from the underside of the deck. By extending the cylinder rod and pushing the intersection of the tensile members 45 away from the underside of the deck by distance of, for example, 1½-2 ft. a high tensile load to approximately 60,000 psi may be imposed in the tensile members. The concrete peripheral compression member balances the tensile load.

A presently preferred means of pressurizing the cylinder 48 and imposing and holding the desired tensile load in the tensile members 45 is to inject a mixed liquid epoxy directly into the cylinder under pressure. When the cylinder is extended to the end of its stroke (sized to match the distance by which the tensile members are moved away from the underside of the deck) pressure in the cylinder would be held until the epoxy hardens. When the epoxy is cured, position of the tensile members is fixed and there is no possibility of loss of pressure and/or leakage. In other words, the tensioning system is rigidly fixed.

The roof deck 38 and tensioning device 47, in effect, act like a virtual column that would otherwise be placed in the center of the building at the point of intersection of the tensile members 45. The tensioning device 47 removes a substantial amount of the dead load and any additional live load on the roof deck without adding a center column support. Thus, in the present example, the building 35 provides a 50 ft.×60 ft. clear span with no interrupting columns. The operation of the tensioning device 47 results in upward force being imposed on the roof deck 38 sufficient to overcome the downward deflection of the roof deck under dead load and, in addition, to provide a positive upward deflection or camber of the roof deck to handle snow and ice loads. The tensioning device 47 also provides the opportunity to reduce the thickness of both the upper and lower steel skins 17 and 18 to, for example, 0.015 in. or less.

Figure 10:
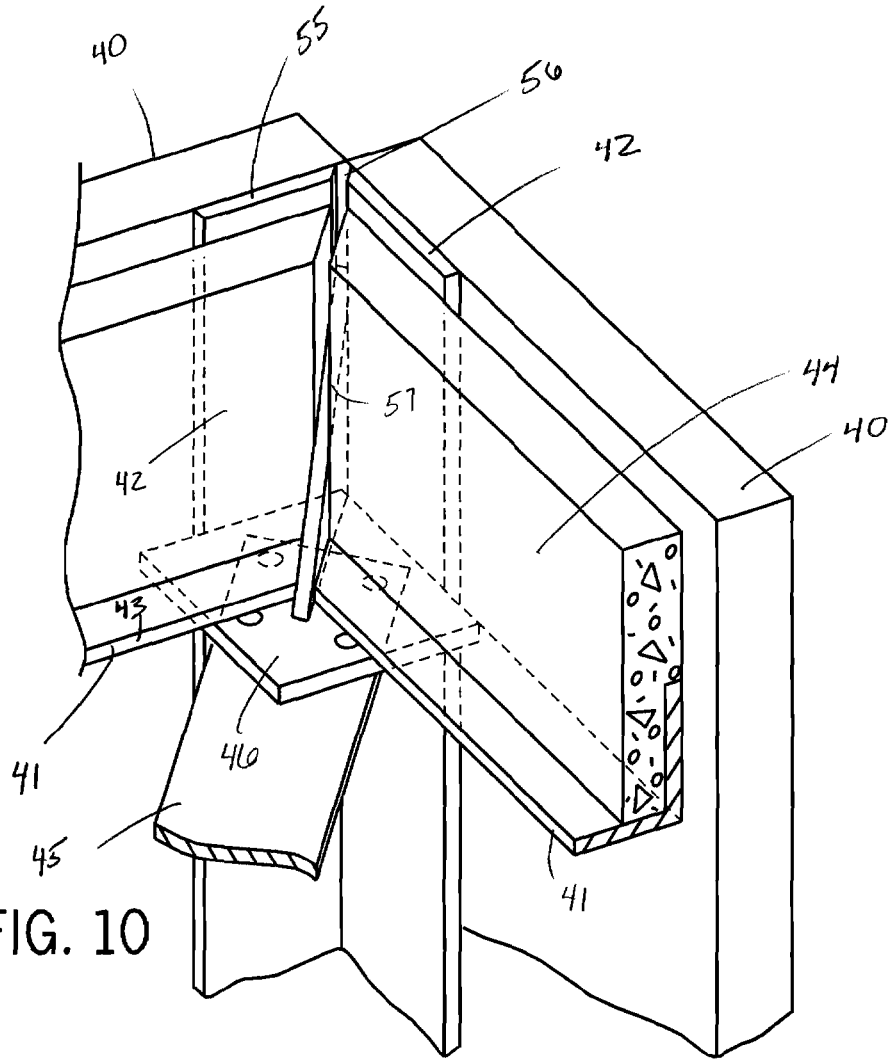
FIG. 10 is an enlarged detail taken on line 10-10 of FIG. 7.

One arrangement for effecting the corner connection of the various elements in the roof deck 38 of FIG. 7 is also shown in the FIG. 10 detail. Each of the four corner columns 42 comprises a vertical angle member 55 that extends from the building foundation to the top of the roof deck 38. The vertical angle member 55 has, for example, 8 in. flanges and a length of about 28 ft. for the two story building shown. In the seam where the flanges join, the upper end of the angle member 55 is cut to provide a vertical slot 56 about ½ in. to ⅝ in. wide and 2½-3 ft. long. A triangular gusset plate 57 is welded in the slot 56 and to the top face of the anchor plate 46. The anchor plate, in turn, provides for connection to the tensile members 45 and also for attachment of the horizontal angle members 41, the peripheral concrete compression member 44, and the corner of the roof deck 38. A tight and rigid connection is thus provided for each corner of the roof deck.

Referring to FIG. 8, the second floor 36 of the building is preferably constructed in a manner described for the structural deck 10 of FIG. 1. Thus, the second floor deck 36 is made of modules 11 having hollowcore elements 13 enclosed with upper and lower skin sheets 17 and 18. The floor deck is also covered with a layer of concrete 12 of a suitable thickness, for example, 2 in.-4 in. Because the floor deck 36 does not include a tensioning device 47 as does the roof deck, the skin sheets 17 and 18 must be of somewhat greater thickness, for example, 0.020 in.

The roof is supported along its peripheral edges on horizontal angle members 58 which are connected by welding or other rigid connections to the inside faces of the vertical column 42. As may be seen in FIGS. 7 and 9, the floor deck 36 is made with one less hollowcore module 11 than the roof deck 38. The free front edge 60 of the floor deck 36 is reinforced to form a beam-like structure 61 along the front edge 60. The beam structure is conveniently formed of long, narrow hollowcore beam elements 62 having their own narrow enclosing skins 63 and attached to the upper and lower skins 17 and 18, respectively, along the free front edge 60. The beam-like structure provides support for the edge in lieu of a horizontal angle member 58 used to support the other three edges of the floor 36. As shown, the lower beam element is somewhat deeper than the upper beam element.

While the plate structure reduces the tension and compression in the skins, it also reduces the shear stress in the core by a factor of two because there is support on all four sides as opposed to just two opposite walls. This means that for normal roof loadings and floor loadings, the arrangement brings the normal shear stress requirements down to the range that can be accommodated with the low density paper core material, as described herein.

Figure 12:
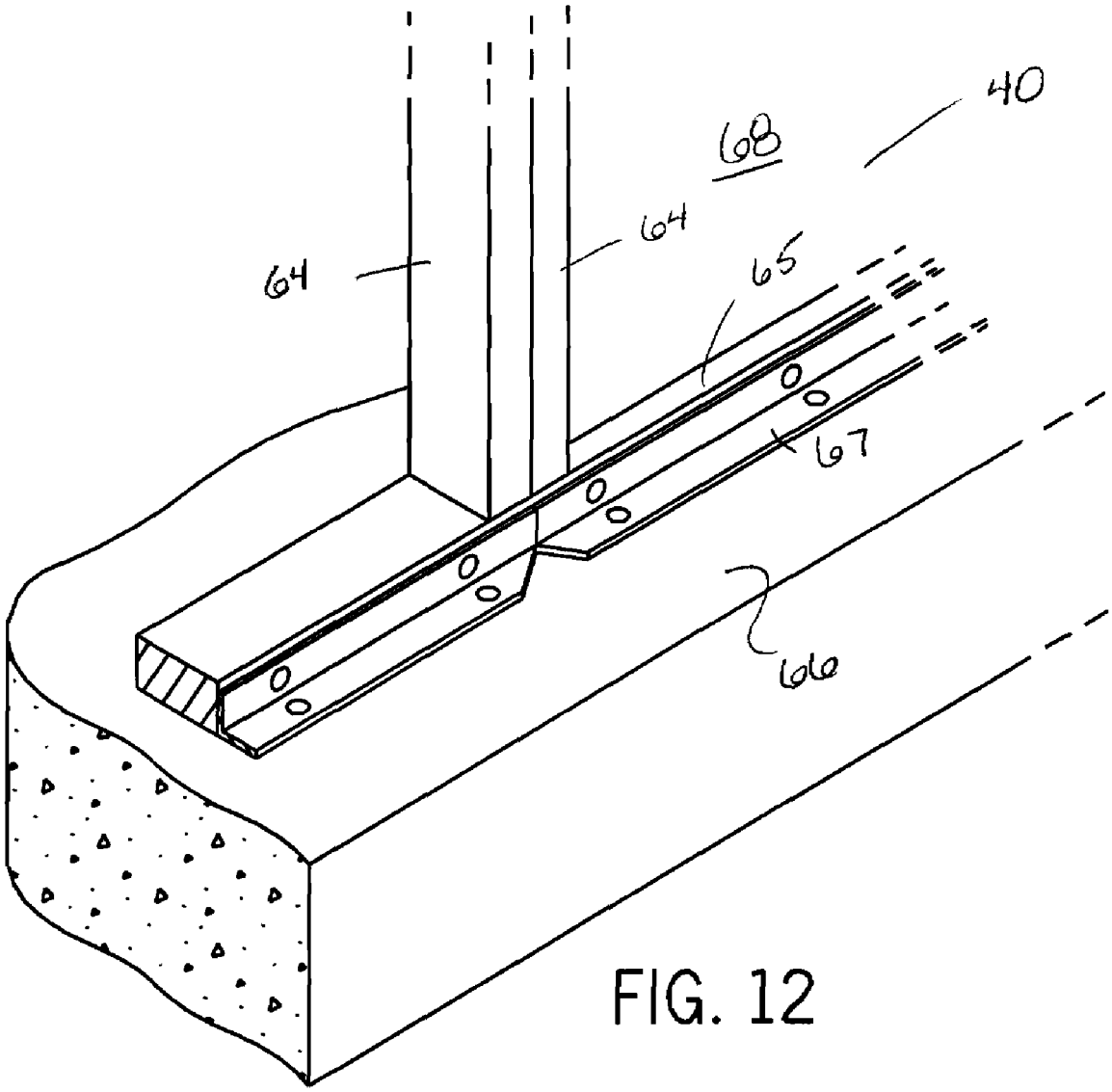
FIG. 12 is an enlarged detail taken on line 12-12- of FIG. 7.

As indicated above, the wall panels 40 are also preferably constructed using hollowcore elements similar to the elements 13 used in the FIG. 1 building. As shown in FIGS. 9 and 12, the wall panels 40 are tied together by wooden closeouts 64 extending vertically along adjacent panel edges. The closeouts 64 are glued or otherwise fastened together to form a rigid continuous wall. The wall panels are 28 ft. long for the two story building shown in FIG. 7 and may typically be 10 ft. in width to match the modularity of the elements used for the roof and second floor.

Preferably, however, the wall panels 40 are also faced with outer skins 68 and inner skins 70 of thin steel or similar construction, the abutting edges with the columns of which are connected by gluing or other suitable connections, as described above with respect to the modules 11 forming the roof and second floor. Thus, the wall panels would also act as a continuous plate member, just as the roof and second floor decks. This rigid construction, coupled with the continuous roof and floor decks, post-stressing of the roof deck, and the rigid corner connections together provide tremendous load transferring capability and an extremely rigid structure. For example, a wind load perpendicularly against one of the walls will be transferred throughout and resisted by the entire structure.

Figure 15:
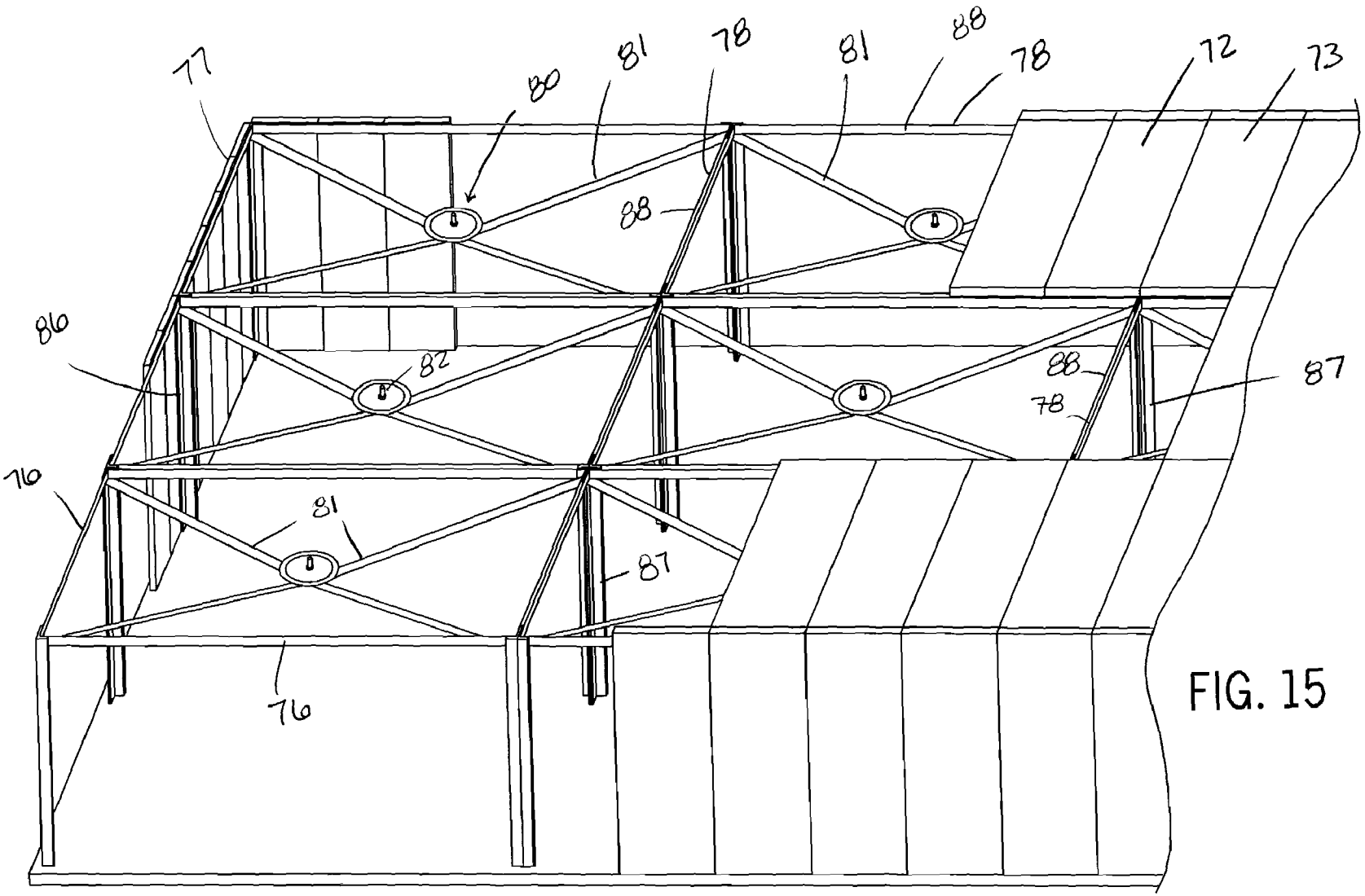
FIG. 15 is a perspective view of a large building that uses a plurality of small roof decks of the FIG. 7 building.

Referring now to FIG. 15, there is shown a large building 71 that is constructed of a plurality of roof decks 38 of small building 35 using the same principles of post-stressing and stress distribution described above with respect to the small building 35. A large building 71 of virtually any size could be constructed. In the FIG. 15 building 71, the roof 73 is made of large building modules 72, each of which is, in effect, a roof deck 38 of the small building 35 of FIG. 7.

In the large building 71, a plurality of rectangular large building modules 72 are positioned side-to-side and end-to-end to define the roof 73. Each large building module 72, like the roof deck 38, is in turn made of plurality of modules 11 as previously described.

The entire outer edge of the large roof 73 is enclosed by a major peripheral compression member 74. As in the small building 35, the major compression member 74 is made of reinforced concrete and is supported along its lower edge on the horizontal flange 75 of a peripheral angle member 76. The peripheral edges of each large building module 72 not supported along an outer wall 77 are enclosed by minor peripheral compression members 78. Thus, building modules 72 in the corner of the building 71 will have two edges supported on a peripheral angle member 76 and two edges closed and supported by a minor peripheral compression member 78. Large building modules 72 along one building wall 77 will have one edge supported on a peripheral angle member 76 and the other three edges closed and supported by a minor peripheral compression member 78. In the interior of the building 71, all modules 72 not supported along an outer wall 77 will be closed on all four sides and supported by a minor peripheral compression member 78. The minor compression members 78 comprise beams which are, in effect, dispersed in a checkerboard pattern in a manner allowing them to carry approximately the same loads in both directions as a result of the diaphragm construction of the roof module 72. The beams, of course, also support vertical loads from the roof modules as well.

Each large building module has a tensioning arrangement 80 that includes diagonal tensile members 81 and a tensioning device 82 which may be identical, respectively, to the tensile members 45 and tensioning device 47 used to post-stressed the roof deck 38 of FIG. 7. Hydraulic cylinders 83 for the respective tensioning devices 82 are tied together with a common hydraulic pressure system so that all tensile members 81 are deflected and stressed equally and simultaneously. As with the small building 35 previously described, the tensile load imposed in the tensile members 81 is balanced by the compression load in the compression members 74 and/or 78, depending on the location of the module 72. To tie the structure of the large roof 73 and the co-acting tensioning arrangements 80, the junctions of the ends of tensile members 81 of adjacent modules 72, and the junctions of the ends of tensile members 81 with the ends of minor peripheral compression members 78 and with the major peripheral compression member 74 are connected. The corners of each of the large building modules 72 are supported at their corners on vertical columns 84. The columns at the corners of the large building may be angle members as described with respect to the columns 42 of the FIG. 1 small building. The columns 86 located along a wall and the interior columns 87 may be of any suitable construction depending on the anticipated roof load. The minor peripheral compression members 78 may conveniently comprise inverted T-sections 88 made of steel. These sections could be adapted to be attached to and support the edges of adjacent roof decks 38 which comprise the large building modules 72 forming the roof 73. Of course, as explained above, the skin sheets along the edges of adjoining large building modules 72 are also welded or otherwise securely connected.

Figure 16:
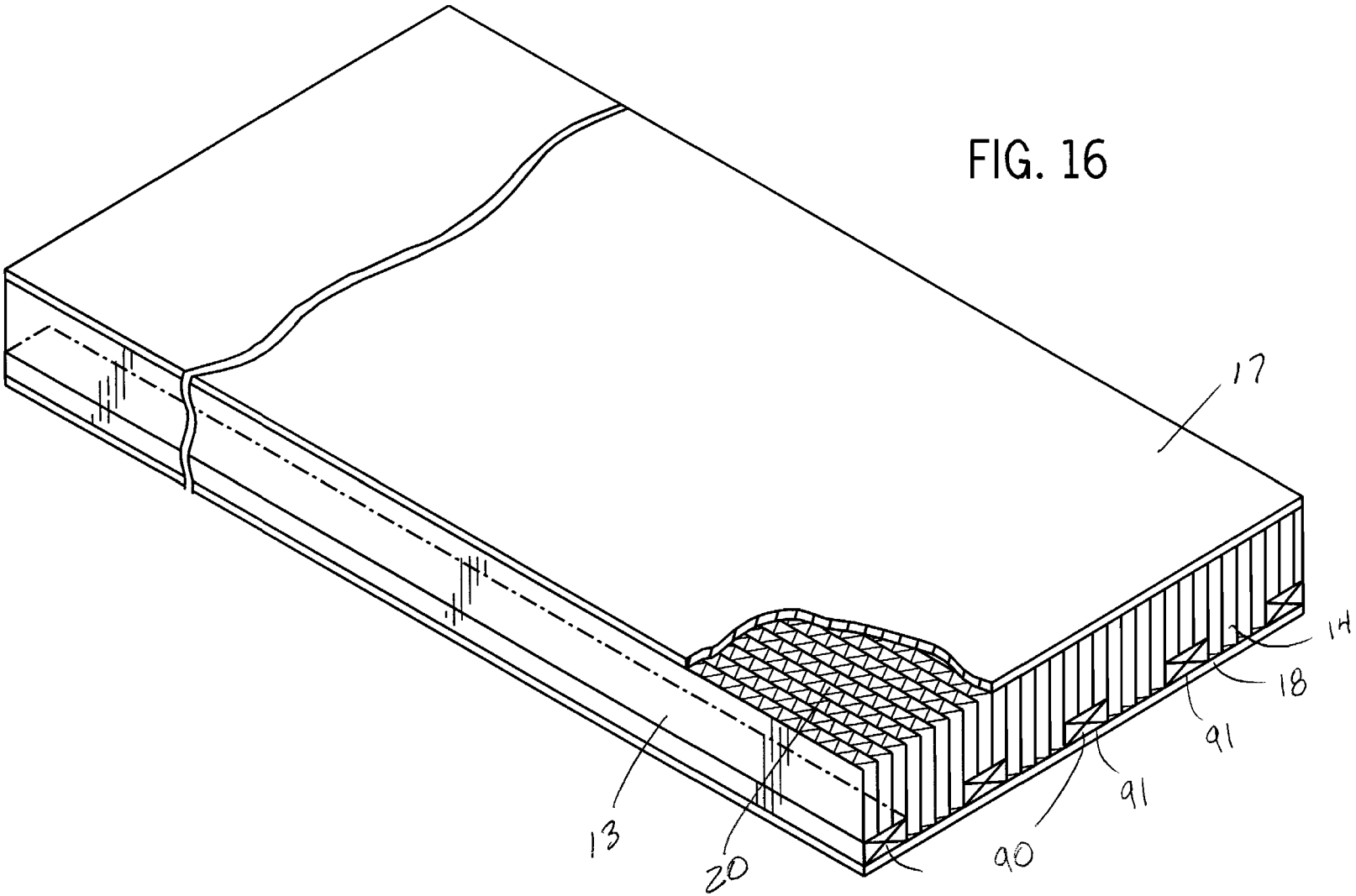
FIG. 16 is a perspective view similar to FIG. 2 showing a single open core module incorporating a connector support system.

Referring now to FIG. 16, in order to provide convenient and easily accessible areas to attach equipment, hangers, wiring and the like to the underside of a module 11, portions of the hollowcore element 13 may be routed or cut out before the lower skin 18 is attached and suitable wooden connector supports 89 inserted into the cut out portions. The connector supports 90 preferably comprise wooden members, such as 2 in.×4 in. pieces that extend the full length (e.g. 50 ft.) of the module 11. The connector supports 90 may be spaced at 16 in. intervals or any other convenient spacing. Connections to the underside of the module are made by drilling through the lower skin sheet 18 and into the wooden support 90. The outer surfaces 91 of the supports are in contact with and secured in the gluing operation to the lower skin sheet 18. Similar connector supports could also be embedded in the core material at the upper surface of the module and flush with the upper skin sheet 17.

I claim:

1. A structural roof or floor plate comprising:

a rectangular open core element formed from strips of a web material expanded and connected to define open cores and with the open cores oriented to extend vertically, said open core element having horizontal upper and lower surfaces;

skin sheets attached to the upper and lower surfaces of the core element;

a peripheral compression member enclosing the core element;

a pair of post-stressing tensile members attached to the core element and the compression member and extending diagonally across the underside of the core element between opposite corners; and a tensioning device interconnecting the tensile members at their intersection and the underside of the core element, the tensioning device operative to move the tensile members vertically away from the underside of the core element and to impose a given tensile load in the tensile members and a compression load in the peripheral compression member.

2. The roof or floor plate as set forth in claim 1 wherein the web material for the open cores of the core element comprises corrugated paper.

3. The roof or floor plate as set forth in claim 2 wherein the web material is waterproof.

4. The roof or floor plate as set forth in claim 1 wherein the open cores of the core element are filled with an insulating foam.

5. The roof or floor plate as set forth in claim 1 comprising an anchor plate at each corner of the core element to provide interconnection between the core element, the compression member, and the tensile members.

6. The roof or floor plate as set forth in claim 5 wherein the anchor plates comprise bearing plates for supporting the structural plate on vertical corner columns.

7. The roof or floor plate as set forth in claim 5 wherein the peripheral compression member comprises reinforced concrete.

8. The roof or floor plate as set forth in claim 1 wherein the tensioning device comprises:

a fluid cylinder having a cylinder body embedded in the open core element and a rod end connected to the tensile members at their intersection; and, an operating system for applying fluid pressure to the cylinder to extend the rod end.

9. The roof or floor plate as set forth in claim 8 wherein the operating fluid comprises the liquid components of a hardenable epoxy adhesive.

10. The roof or floor plate as set forth in claim 9 wherein the operating system is operative to hold the cylinder rod end in a selected extended position until the epoxy adhesive hardens.

11. The roof or floor plate as set forth in claim 8 including a load distribution plate fixed to the cylinder body and bearing against the lower skin sheet of the core element.

12. The roof or floor plate as set forth in claim 11 including a connector plate fixed to the rod end of the cylinder and bearing against and connected to said tensile members.

13. The roof or floor plate as set forth in claim 12 including a peripheral support for the compression member, said peripheral support comprising a rectangular array of angle members, each having a horizontal flange supporting the compression member, the horizontal flange in turn supported at opposite ends on the anchor plates.

* * * * *